US006253796B1

(12) United States Patent
Wilson et al.

(10) Patent No.: US 6,253,796 B1
(45) Date of Patent: Jul. 3, 2001

(54) PAPERMAKER'S FORMING FABRIC

(75) Inventors: Robert G. Wilson, Wake Forest, NC (US); Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 09/628,668

(22) Filed: Jul. 28, 2000

(51) Int. Cl.[7] ..... D03D 13/00
(52) U.S. Cl. ..... 139/383 A
(58) Field of Search ..... 139/383 A; 162/903

(56) References Cited

U.S. PATENT DOCUMENTS

| | | | |
|---|---|---|---|
| Re. 33,195 | 4/1990 | McDonald et al. | 139/425 A |
| Re. 35,777 | 4/1998 | Givin | 139/383 A |
| 2,172,430 | 9/1939 | Barrell | 139/383 |
| 2,554,034 | 5/1951 | Koester et al. | 139/426 |
| 3,094,149 | 6/1963 | Keily | 139/383 |
| 3,325,909 | 6/1967 | Clark | 34/95 |
| 4,093,512 | 6/1978 | Fleischer | 162/348 |
| 4,182,381 | 1/1980 | Gisbourne | 139/383 A |
| 4,244,543 | 1/1981 | Ericson | 248/55 |
| 4,289,173 | 9/1981 | Miller | 139/383 A |
| 4,290,209 | 9/1981 | Buchanan et al. | 34/123 |
| 4,414,263 | 11/1983 | Miller et al. | 428/234 |
| 4,438,788 | 3/1984 | Harwood | 139/383 A |
| 4,452,284 | 6/1984 | Eckstein et al. | 139/383 A |
| 4,453,573 | 6/1984 | Thompson | 139/383 A |

(List continued on next page.)

FOREIGN PATENT DOCUMENTS

| | | | |
|---|---|---|---|
| 1115177 | 12/1981 | (CA) | 139/58 |
| 2-277848 | 11/1990 | (CN) | D03D/15/00 |
| 454 092 | 12/1927 | (DE) . | |
| 33 29 740 | 3/1985 | (DE) | D03D/11/00 |
| 0 048 962 | 9/1981 | (EP) | D03D/1/00 |
| 0 158 710 | 10/1984 | (EP) | D03D/1/00 |
| 0 185 177 | 10/1985 | (EP) | D03D/11/00 |
| 0 224 276 | 12/1986 | (EP) . | |
| 0 264 881 | 10/1987 | (EP) | D21F/1/00 |
| 0 269 070 | 11/1987 | (EP) | D03D/11/00 |

(List continued on next page.)

OTHER PUBLICATIONS

Warren, C.A., "The Importance of Yarn Properties in Wet–End Wire Construction," Seminar, The Theory of Water Removal, Dec. 12, 1979.

International Search Report for PCT Application No. PCT/US97/18629.

Rule 132 Declaration of Robert G. Wilson (Jun. 26, 1997).

*Primary Examiner*—Andy Falik
(74) *Attorney, Agent, or Firm*—Myers Bigel Sibley & Sajovec

(57) ABSTRACT

A multilayer papermaker's fabric includes: a first set of machine direction yarns; a top set of cross machine direction yarns interwoven with the first set of machine direction yarns; and a bottom set of cross machine direction yarns interwoven with the first set of machine direction yarns. The first set of machine direction yarns, the top set of cross machine direction yarns, and the bottom set of cross machine direction yarns are interwoven in a repeat pattern in which each of the machine direction yarns passes below at least two nonadjacent bottom cross machine direction yarns, in which each adjacent pair of machine direction yarns passes below a common bottom cross machine direction yarn to form side-by side bottom knuckles, and in which machine direction yarns adjacent to and sandwiching the adjacent pair of machine direction yarns forming the side-by-side bottom knuckles pass over a top cross machine direction yarn positioned substantially directly above the bottom cross machine direction yarn under which the bottom knuckles are formed such that a phantom float is formed on that top cross machine direction yarn.

22 Claims, 12 Drawing Sheets

U.S. PATENT DOCUMENTS

| | | | | |
|---|---|---|---|---|
| 4,501,303 | | 2/1985 | Osterberg | 139/425 A |
| 4,515,853 | | 5/1985 | Borel | 428/257 |
| 4,529,013 | | 7/1985 | Miller | 139/383 A |
| 4,564,052 | | 1/1986 | Borel | 139/425 A |
| 4,592,395 | | 6/1986 | Borel | 139/383 A |
| 4,592,396 | | 6/1986 | Borel et al. | 139/425 |
| 4,605,585 | | 8/1986 | Johansson | 428/224 |
| 4,611,639 | | 9/1986 | Bugge | 139/383 A |
| 4,621,663 | | 11/1986 | Malmendier | 139/383 A |
| 4,633,596 | | 1/1987 | Josef | 34/116 |
| 4,636,426 | | 1/1987 | Fleischer | 428/224 |
| 4,642,261 | | 2/1987 | Fearnhead | 428/225 |
| 4,676,278 | | 6/1987 | Dutt | 139/383 A |
| 4,705,601 | | 11/1987 | Chiu | 162/348 |
| 4,709,732 | | 12/1987 | Kinnunen | 139/383 A |
| 4,729,412 | | 3/1988 | Bugge | 139/383 A |
| 4,731,281 | | 3/1988 | Fleischer et al. | 428/196 |
| 4,739,803 | | 4/1988 | Borel | 139/383 A |
| 4,755,420 | | 7/1988 | Baker et al. | 428/222 |
| 4,759,975 | | 7/1988 | Sutherland et al. | 428/234 |
| 4,815,499 | | 3/1989 | Johnson | 139/383 |
| 4,815,503 | | 3/1989 | Borel | 139/383 A |
| 4,909,284 | | 3/1990 | Kositzke . | |
| 4,934,414 | | 6/1990 | Borel | 139/383 A |
| 4,941,514 | | 7/1990 | Taipale | 139/383 A |
| 4,942,077 | | 7/1990 | Wendt et al. | 428/152 |
| 4,945,952 | | 8/1990 | Vöhringer | 139/383 |
| 4,967,805 | | 11/1990 | Chiu et al. | 139/383 |
| 4,987,929 | | 1/1991 | Wilson | 139/383 A |
| 4,989,647 | | 2/1991 | Marchand | 139/383 A |
| 4,989,648 | | 2/1991 | Tate et al. | 139/383 |
| 4,998,568 | | 3/1991 | Vohringer | 139/383 A |
| 4,998,569 | | 3/1991 | Tate | 139/383 A |
| 5,025,839 | | 6/1991 | Wright | 139/383 A |
| 5,074,339 | | 12/1991 | Vohringer | 139/383 A |
| 5,084,326 | | 1/1992 | Vohringer | 428/194 |
| 5,092,372 | | 3/1992 | Fitzka et al. | 139/383 A |
| 5,101,866 | | 4/1992 | Quigley | 139/383 |
| 5,116,478 | | 5/1992 | Tate et al. | 162/358 |
| 5,152,326 | | 10/1992 | Vohringer | 139/383 A |
| 5,158,118 | | 10/1992 | Tate et al. | 139/383 A |
| 5,219,004 | | 6/1993 | Chiu | 139/383 A |
| 5,228,482 | | 7/1993 | Fleischer | 139/383 A |
| 5,277,967 | * | 1/1994 | Zehle et al. | 139/383 A |
| 5,358,014 | | 10/1994 | Kovar | 139/383 A |
| 5,421,374 | | 6/1995 | Wright | 139/383 A |
| 5,421,375 | | 6/1995 | Praetzel | 139/383 A |
| 5,429,686 | | 7/1995 | Chiu et al. | 139/383 |
| 5,449,026 | | 9/1995 | Lee | 139/383 A |
| 5,454,405 | | 10/1995 | Hawes | 139/383 A |
| 5,456,293 | | 10/1995 | Ostermayer et al. | 139/383 A |
| 5,465,764 | | 11/1995 | Eschmann et al. | 139/383 A |
| 5,482,567 | | 1/1996 | Barreto | 139/383 A |
| 5,487,414 | | 1/1996 | Kuji et al. | 139/383 |
| 5,518,042 | | 5/1996 | Wilson | 139/383 A |
| 5,520,225 | | 5/1996 | Quigley et al. | 139/383 A |
| 5,542,455 | | 8/1996 | Ostermayer et al. | 139/383 A |
| 5,555,917 | | 9/1996 | Quigley | 139/383 A |
| 5,564,475 | | 10/1996 | Wright | 139/383 A |
| 5,641,001 | | 6/1997 | Wilson | 139/383 A |
| 5,651,394 | | 7/1997 | Marchand | 139/383 |
| 5,709,250 | | 1/1998 | Ward et al. | 139/383 A |
| 5,746,257 | | 5/1998 | Fry | 139/383 AA |
| 5,826,627 | | 10/1998 | Seabrook et al. | 139/383 A |
| 5,857,498 | * | 1/1999 | Barreto et al. | 139/383 A |
| 5,881,764 | | 3/1999 | Ward | 139/383 A |
| 5,937,914 | | 8/1999 | Wilson | 139/383 A |
| 6,148,869 | * | 11/2000 | Quigley | 139/383 A |

FOREIGN PATENT DOCUMENTS

| | | | |
|---|---|---|---|
| 0 284 575 | 2/1988 | (EP) | D21F/1/00 |
| 0 283 181 | 3/1988 | (EP) | D21F/1/00 |
| 0 350 673 | 6/1989 | (EP) | D21F/1/00 |
| 0 048 849 A2 | 5/1990 | (EP) | D21F/1/00 |
| 0 048 849 A3 | 5/1990 | (EP) . | |
| 0 672 782 | 3/1995 | (EP) | D21F/1/00 |
| 0 794 283 A1 | 9/1997 | (EP) | D21F/1/00 |
| 2 597 123 | 4/1986 | (FR) | D03D/11/00 |
| 8605115 | 4/1986 | (FR) . | |
| 2157328A | 10/1985 | (GB) | D03D/1/00 |
| 2245006 | 2/1991 | (GB) | D03D/11/00 |
| 8-158285 | 12/1994 | (JP) . | |
| 9-41282 | 7/1995 | (JP) . | |
| 9-87990 | 9/1995 | (JP) . | |
| WO 86/00099 | 1/1986 | (WO) | D21F/1/00 |
| WO 89/09848 | 4/1989 | (WO) | D03D/23/00 |
| WO 93/10304 | 11/1992 | (WO) | D21F/1/10 |

* cited by examiner 620
622
624
626a
626b
628
630
632
634a
634b
636
638
640
642a
642b
644
646
648
650a
650b
602
652
663
666

604
653
661
666

606
654
661
664

608
655
664
667

610
656
662
667

612
657
662
665

614
658
660
665

616
659
660
663

PAPERMAKER'S FORMING FABRIC

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt (or between two endless belts) of woven wire and/or synthetic material that travels between two or more rollers. The belt, often referred to as a "forming fabric", provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity alone or with assistance from one or more suction boxes located on the lower surface (ie., the "machine side") of the upper run of the fabric.

After leaving the forming section, the paper web is transferred to a press section of the paper machine, in which it is passed through the nips of one or more pairs of pressure rollers covered with another fabric, typically referred to as a "press felt." Pressure from the rollers removes additional moisture from the web; the moisture removal is often enhanced by the presence of a "batt" layer on the press felt. The paper is then conveyed to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing a pin-seamable flap on each end or a special foldback, then reweaving these into pin-seamable loops. In a flat woven papermaker's' fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CML) refer, respectively, to a direction aligned with the direction of travel of the papermaker's' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are important considerations in papermaking, especially for the forming section of the papermaking machine, where the wet web is initially formed. Wire marking is particularly problematic in the formation of fine paper grades, as it can affect a host of paper properties, such as sheet mark, porosity, "see-through" and pin holing. Wire marking is typically the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially in terms of skew resistance, narrowing propensity and stiffness), which may negatively impact both the service life and the performance of the fabric.

To combat these problems associated with fine weaves, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, and U.S. Pat. No. 5,437,315 to Ward.

Although these fabrics have performed successfully, they have some potential shortcomings. For example, the coarser CMD yarns used in the bottom layer of the fabric typically have long "floats" (segments that span multiple adjacent MD yarns in the weave pattern) that contact the papermaking machine. This arrangement is desirable, as the MD yarns (which are subjected to most of the tensile load of the fabric during operation) are protected to a large degree from wear; however, the long CMD floats are susceptible to wear over time. In many weave patterns, the floats are somewhat asymmetric; i e., the MD yarns that pass above the float apply forces of varying magnitudes at asymmetric points across the float. As a result, the floats can be somewhat asymmetric in shape, thereby protruding toward the papermaking machine in a non-uniform manner. The locations on the floats that protrude the most tend to receive the most wear during operation.

Another concern regarding multilayer fabrics, and in particular double layer fabrics, is their ability to provide additional fiber support, as described above. In many weaves, long cross machine direction yarn floats, either in the form of primary CMD yarns or additional "fiber support" yarns, provide much of the support and coplanarity on the papermaking surface for cellulosic fibers. Conversely, in areas lacking a cross machine direction float (i.e., locations where an MD yarn forms a paper side knuckle or float), fibers typically receive less support and coplanarity of the papermaking surface may be reduced. These locations may be susceptible to negatively impact the performance parameters affected by a lack of fiber support.

SUMMARY OF THE INVENTION

In view of the foregoing, it is an object of the present invention to provide a papermaker's fabric suitable for forming tissue paper.

It is another object of the present invention to provide a papermaker's forming fabric that addresses the permeability and top CMD spacing uniformity problems described above.

It is an additional object of the present invention to provide a double layer papermaker's fabric with reduced caliper, reduced void volume, low air permeability and increased life potential.

It is a further object of the present invention to provide a triple layer papermaker's fabric with improved life potential.

These and other objects are satisfied by the present invention, which includes a papermaker's fabric that can improve fiber support, wear resistance, caliper, and other papermaking properties. The fabric includes: a first set of machine direction yarns; a top set of cross machine direction yarns interwoven with the first set of machine direction yarns; and a bottom set of cross machine direction yarns interwoven with the first set of machine direction yarns. The first set of machine direction yarns, the top set of cross machine direction yarns, and the bottom set of cross machine direction yarns are interwoven in a repeat pattern in which each of the machine direction yarns passes below at least two nonadjacent bottom cross machine direction yarns, in which each adjacent pair of machine direction yarns passes below a common bottom cross machine direction yarn to form side-by side bottom knuckles, and in which machine direction yarns adjacent to and sandwiching the adjacent pair of machine direction yarns forming the side-by-side bottom knuckles pass over a top cross machine direction yarn positioned substantially directly above the bottom cross machine direction yarn under which the bottom knuckles are formed such that a phantom float is formed on that top cross machine direction yarn. As described in detail below, such a configuration in a double layer fabric can enable the phantom float to participate more fully in the fiber support of the fabric and, as such, improve fiber support in locations between long CMD floats on the papermaking surface (i.e., the locations of the phantom floats). Also, this configuration can improve wear resistance by providing a more symmetric bottom side CMD float as a contact point with the papermaking machine.

As a second aspect, the present invention is directed to a triple layer papermaker's fabric that comprises: a set of top machine direction yarns; a set of bottom machine direction yarns; a set of top cross machine direction yarns interwoven with the top machine direction yarns to form a top fabric layer; a set of bottom machine direction yarns; a bottom set of cross machine direction yarns interwoven with the bottom machine direction yarns to form a bottom fabric layer; and a plurality of cross machine direction stitching yarns interweaving with the top and bottom machine direction yarns to interconnect the top and bottom fabric layers. The bottom machine direction yarns and the bottom cross machine direction yarns are interwoven in a repeat pattern in which each of the bottom machine direction yarns passes below at least two nonadjacent bottom cross machine direction yarns, thereby forming bottom side machine direction knuckles, and wherein each adjacent pair of machine direction yarns passes below a common bottom cross machine direction yarn to form side-by-side bottom knuckles. In this configuration, the bottom layer may have improved wear resistance, higher air permeability, and other performance benefits compared to other triple layer fabrics with shorter bottom layer floats.

DETAILED DESCRIPTION OF THE PREFERRED EMBODIMENTS

Figure 1:
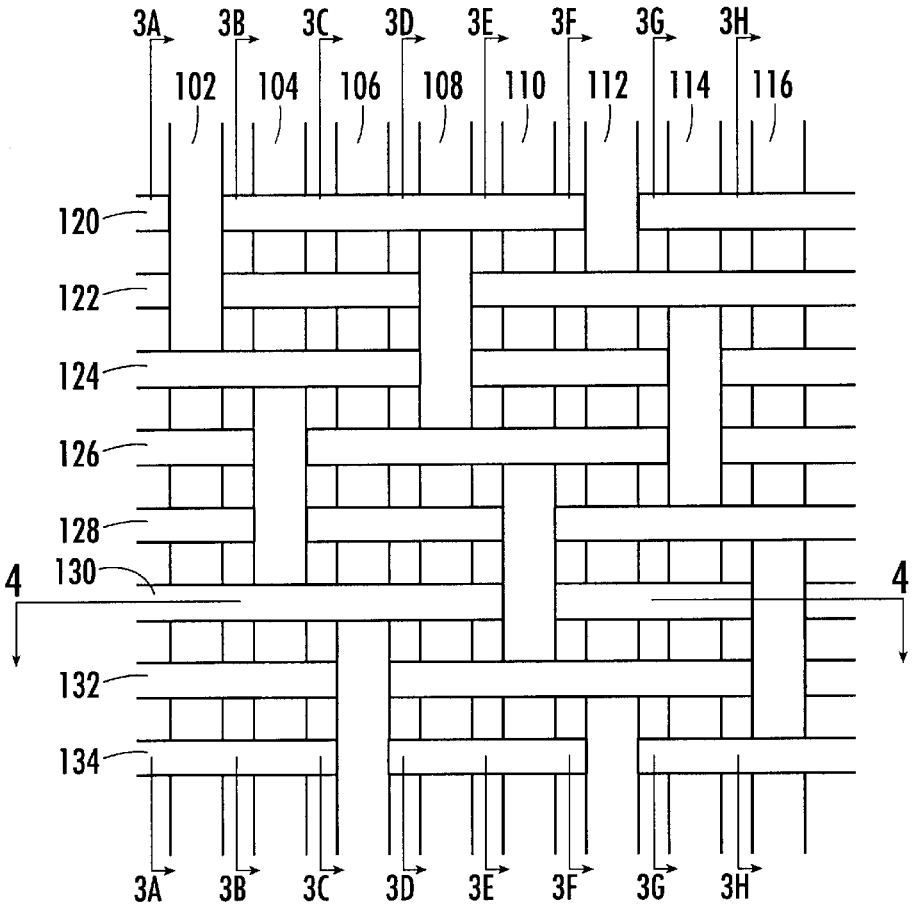
FIG. 1 is a top view of a double layer papermaker's forming fabric of the present invention.
Figure 2:
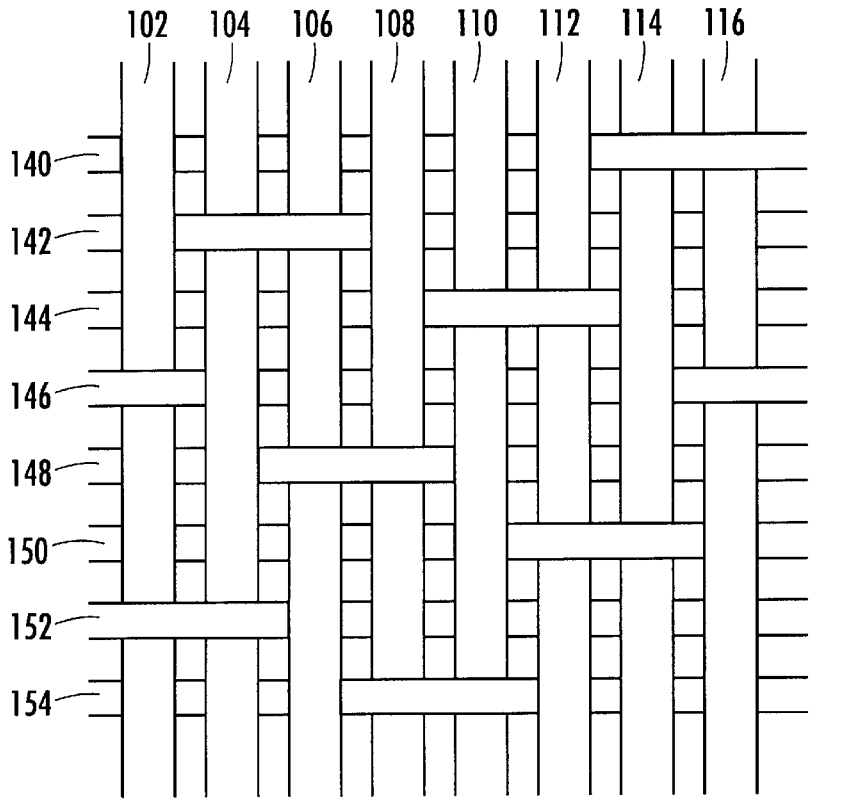
FIG. 2 is a partial top view of the fabric of FIG. 1 with the top CMD yarns removed.
Figure 3A:
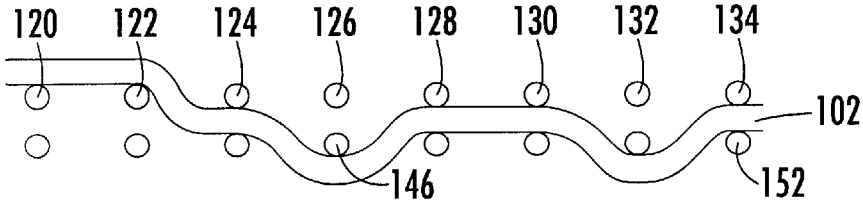
FIGS. 3A–3H are section views taken along lines 3A—3A through 3H—3H of FIG. 1.
Figure 3B:
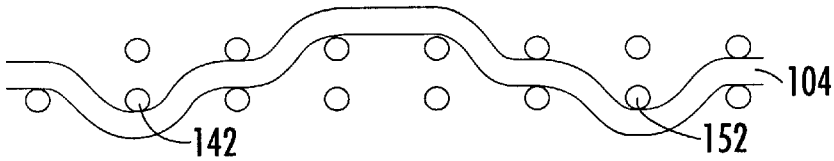
Figure 3C:
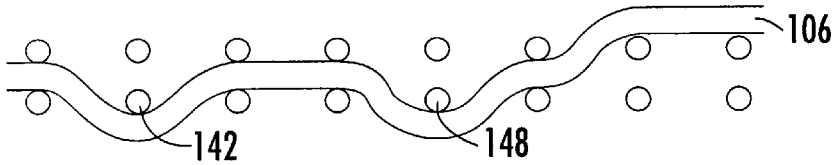
Figure 3D:
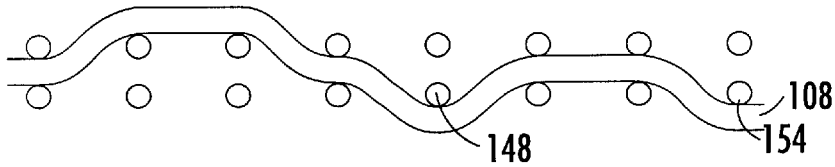
Figure 3E:
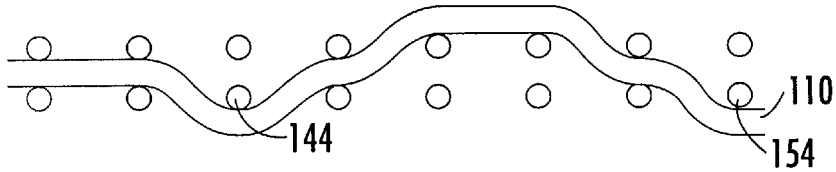
Figure 3F:
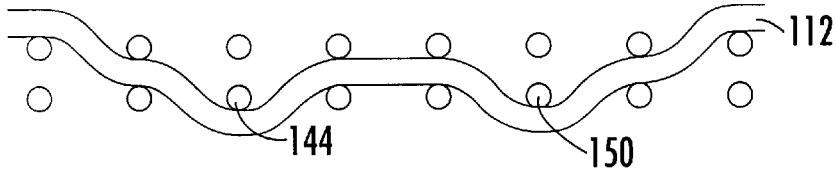
Figure 3G:
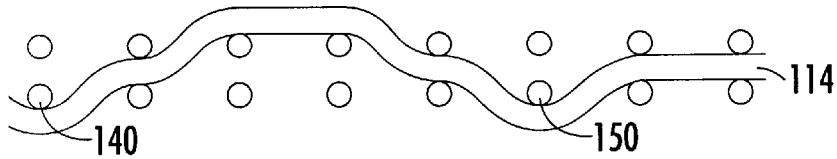
Figure 3H:
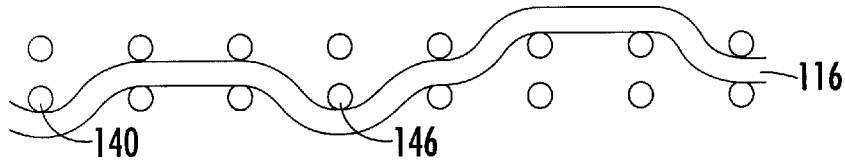

The present invention will now be described more particularly hereinafter with reference to the accompanying drawings, in which present embodiments of the invention are shown. The invention, however, be embodied in many different forms and is not limited to the embodiments set forth herein; rather, these embodiments are provided so that the disclosure will fully convey the scope of the invention to those skilled in the art. Like numbers refer to like components throughout. The dimensions and thicknesses for some components and layers may be exaggerated for clarity.

Turning now to the figures, a double layer forming fabric, designated broadly at 100, is illustrated in FIGS. 1–4. The fabric 100 includes eight consecutive machine direction yarns 102, 104, 106, 108, 110, 112, 114 and 116, which are interwoven with a set of eight top CMD yarns 120, 122, 124, 126, 128, 130, 132, and 134 and with a set of eight bottom CMD yarns 140, 142, 144, 146, 148, 150, 152 and 154. Notably, in this embodiment each bottom CMD yarn is located substantially directly below a corresponding top CMD yarn. The section of fabric illustrated in FIGS. 1–4 constitutes a single repeat unit of a larger fabric comprising multiple repeat units; of course, the repeat unit can begin at any point within this pattern so long as the pattern is maintained.

Referring to FIGS. 1 and 3A–3H, each MD yarn interweaves with the top CMD yarns such that it passes over two adjacent top CMD yarns, then passes below six consecutive top CMD yarns. For example, MD yarn 102 passes over top CMD yarns 120 and 122, then passes below top CMD yarns 124, 126, 128, 130, 132 and 134. While passing below the top CMD yarns, each MD yarn passes below two bottom CMD yarns that sandwich two other bottom CMD yarns. For example, MD yarn 102, after passing above top CMD yarns 120 and 122, passes above bottom CMD yarn 144, below bottom CMD yarn 146, above bottom CMD yarns 148 and 150, below bottom CMD yarn 152, and above bottom CMD yarn 154. Thus, each MD yarn travels along the following path: above two top CMD yarns, between the next pair of top and bottom CMD yarns, below the next bottom CMD yarn, between the next two pair of top and bottom CMD yarns, below the next bottom CMD yarn, and between the next pair of top and bottom CMD yarns.

Adjacent MD yarns following this interweaving pattern or sequence are offset from one another in the machine direction by three bottom CMD yarns. This can be illustrated by examination of MD yarns 106 and 108 (seen best in FIGS. 3C and 3D.). MD yarn 106 (FIG. 3C) passes below bottom CMD yarns 142 and 148. Adjacent MD yarn 108 (FIG. 3D) passes below bottom CMD yarns 148 and 154. A similar three CMD yarn offset is followed by all of the MD yarns as they pass over top CMD yarns.

As a result of this pattern, adjacent MD yarns form a machine direction "knuckle" (i.e., a location where an MD yarn passes below one CMD yarn only, while passing above the adjacent CMD yarns) below the same bottom CMD yarn (e.g, both of MD yarns 106 and 108 form a knuckle below bottom CMD yarn 148, as described above). It should also be noted that, as adjacent MD yarns form the bottom machine direction knuckles, the two MD yarns that sandwich these adjacent yarns are passing above respective a top CMD yarn that corresponds with (i e., is located directly above) the bottom CMD yarn under which the adjacent MD yarns form the bottom knuckle. This is shown best in FIG. 4, where it can be seen that adjacent MD yarns 112 and 114 form side-by-side bottom MD knuckles 112', 114' below bottom CMD yarn 150. The MD yarns 110, 116 sandwiching these adjacent MD yarns, 112, 114 are each passing over top CMD yarn 130 (which is located substantially directly above bottom CMD yarn 150). Upwardly-directed forces are exerted by the adjacent MD yarns 112 and 114 on bottom CMD yarn 150, which in turn exerts an upwardly-directed force on top CMD yarn 130, thereby urging it to bow slightly upwardly between MD yarns 110 and 116.

Figure 4:
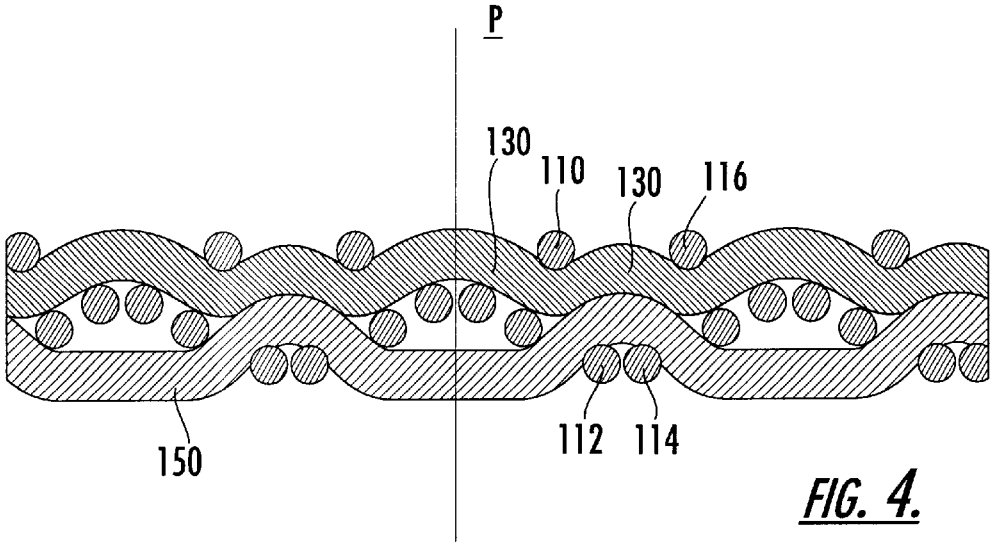
FIG. 4 is a section view of a top CMD yarn and a bottom CMD yarn taken along line 4—4 of FIG. 1.

This slight bulging of the top CMD yarn 130 forms a "phantom float" 130' on the papermaking surface between the MD yarns 110 and 116 (see FIG. 4). As used herein, "phantom float" means a short CMD float (i.e., a portion of a CMD yarn passing over more than one MD yarn) on the papermaking surface that is supported by an adjacent and corresponding bottom CMD yarn such that it is elevated to participate more fully in fiber support. This phantom float supplements the longer floats of top CMD yarn 130 located on either side of the phantom float which are largely responsible for support of fibers in paper stock during the formation of paper. In fact, the presence of the phantom knuckle can help to increase coplanarity of the papermaking surface in the locations between the long floats of the top CMD yarns, which can positively impact the surface of paper produced thereon.

Figure 5B:
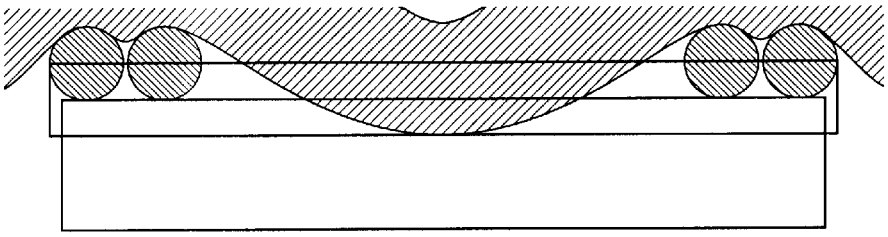
FIG. 5B is a greatly enlarged section view of a prior art fabric showing the difference in wear surface provided by a bottom CMD yarn.
Figure 5A:
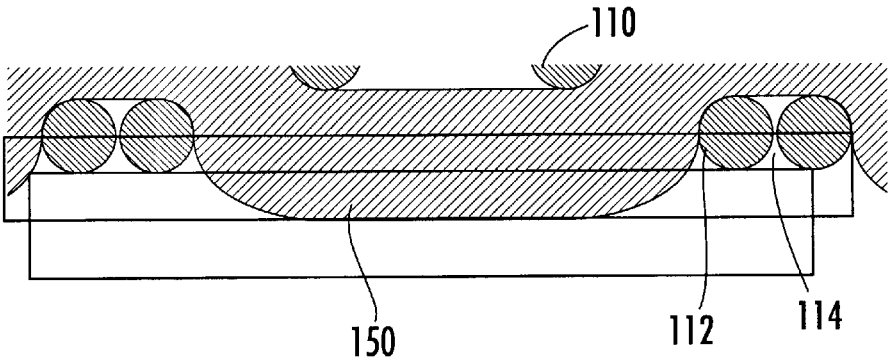
FIG. 5A is a greatly enlarged inset of FIG. 4 showing the wear surface of a bottom CMD yarn.

In addition, this configuration can improve the wear characteristics of the fabric. Turning again to FIG. 4, it can be seen that all four of the MD yarns located between adjacent phantom knuckles pass below the same top CMD yarn (thereby causing the formation of the long CMD paper side "float" on that top CMD yarn) and above the same bottom CMD yarn (causing the formation of a machine side float on that bottom CMD yarn). These four yarns interweave with the top and bottom CMD yarns in such a manner that they are reverse mirror images of one another about a vertical plane P that extends through the center of the aforementioned floats formed by the top and bottom CMD yarns. Because these MD yarns define reverse mirror images, the vertical forces that these MD yarns exert on the top and bottom CMD yarns are relatively balanced about the plane P. Thus, the bottom float formed on the bottom CMD yarn is relatively symmetric and flat (see FIGS. 5A and 5B for comparison of the present fabric 20 to a prior art fabric). The relative symmetry and flatness of the bottom side CMD float can induce more surface area of this float to be in contact with the paper machine than is true for prior art fabrics. Accordingly, there is more surface provided by each bottom CMD yarn to endure wear on the fabric, which can result in higher wear resistance for the overall fabric.

Other benefits and characteristics that may be attributable to the weave pattern of the fabrics of the present invention include reduced caliper (thickness), reduced void volume, high stability (i.e., resistance to skewing in the plane of the fabric), and lower permeability.

Figure 6:
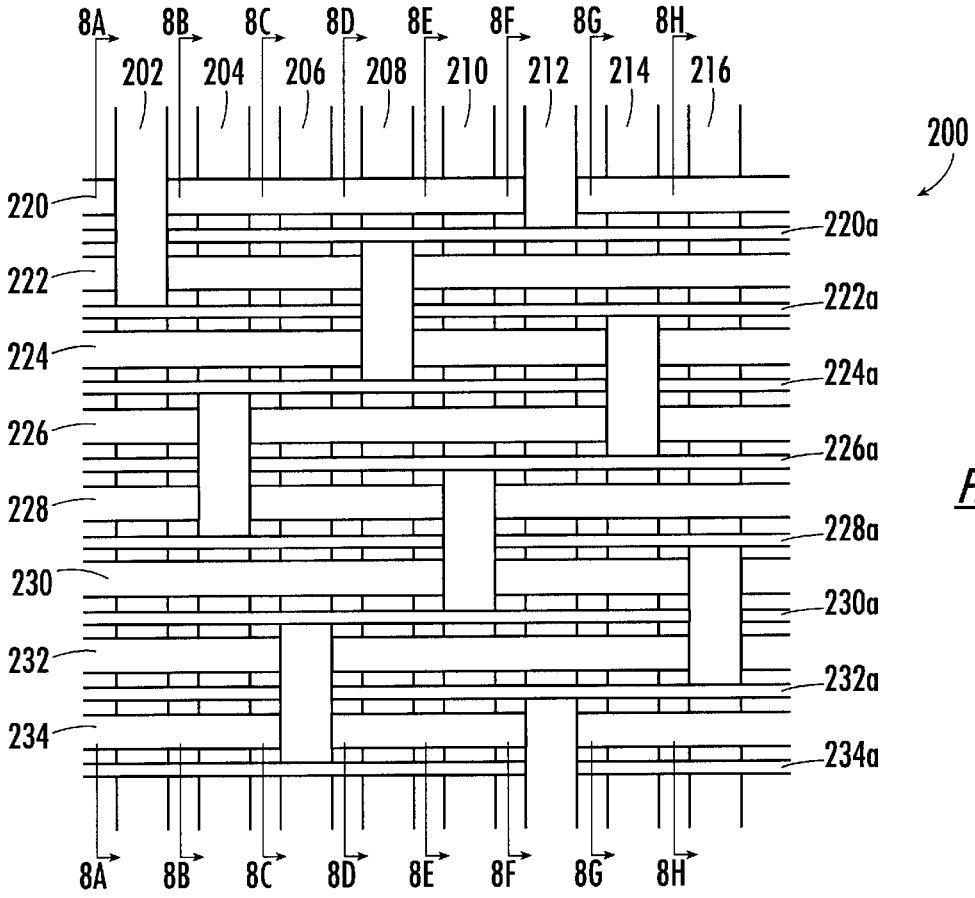
FIG. 6 is a top view of an alternative embodiment of a double layer papermaker's forming fabric of the present invention.
Figure 7:
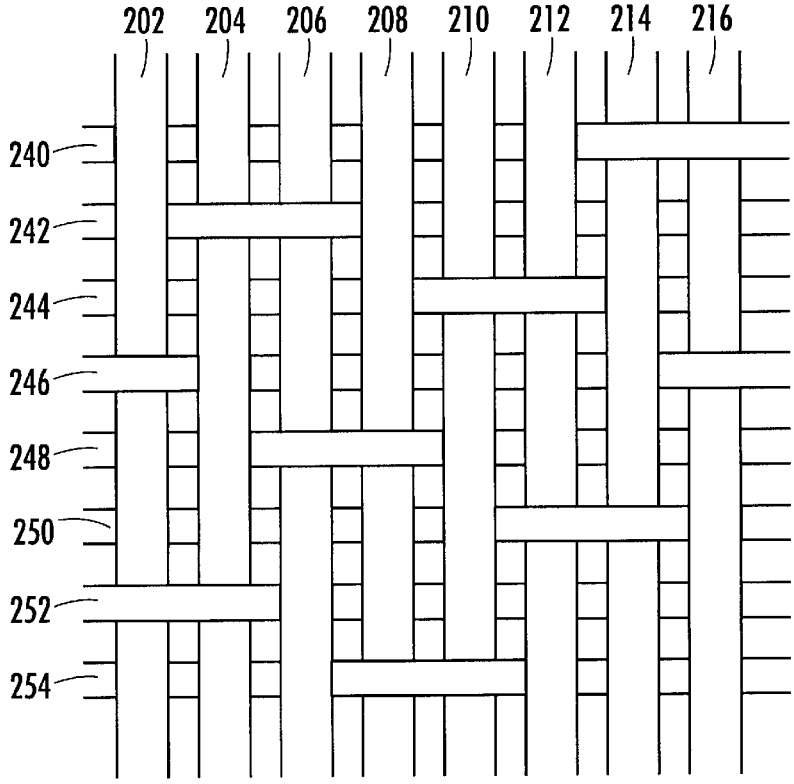
FIG. 7 is a partial top view of the fabric of FIG. 6 with the top CMD yarns and fiber support yarns removed.
Figures 8A, 8B, 8C, 8D, 8E, 8F, 8G, 8H:
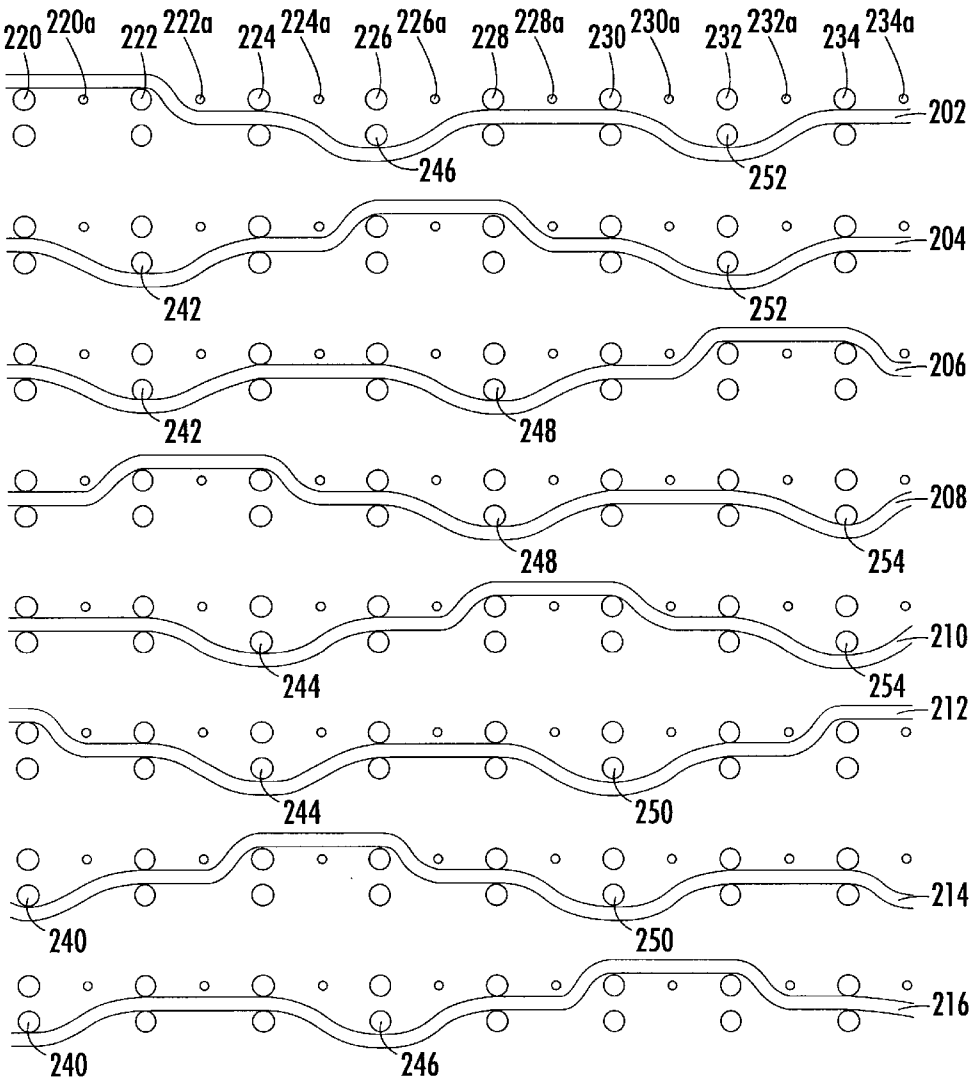
FIGS. 8A–8H are section views taken along, respectively, lines 8A—8A through 8H—8H of FIG. 6.

The performance characteristics and advantages observed in the fabric illustrated in FIGS. 1–5 can be applied to other fabrics as well. For example, a repeat unit of a double layer fabric with additional fiber support yarns, designated broadly at 200, is illustrated in FIGS. 6–8. The fabric 200 includes eight MD yarns 202, 204, 206, 208, 210, 212, 214 and 216, which are interwoven with eight top CMD yarns 220, 222, 224, 226, 228, 230, 232, and 234 and with eight bottom CMD yarns 240, 242, 244, 246, 248, 250, 252, and 254 in the same manner as the MD, top CMD and bottom CMD yarns of the fabric 100 described above. However, the fabric 200 also includes in its repeat unit eight fiber support "picks" 220*a*, 222*a*, 224*a*, 226*a*, 228*a*, 230*a*, 232*a*and 234*a*. Each pick is located between two adjacent top CMD yarns and is interwoven with the MD yarns such that it passes over seven adjacent MD yarns and below an eighth MD yarn. For example, pick 220*a* passes below MD yarn 202 and above MD yarns 204, 206, 208, 210, 212, 214 and 216. Adjacent picks are offset from one another in their weaving sequences by three MD yarns; thus, pick 220*a* passes below MD yarn 202, while pick 222*a* passes below MD yarn 208. As can be seen in FIGS. 8A–8H, each MD yarn passes over only the pick located between the two CMD yarns that MD yarn also passes over; for example, MD yarn 202 passes over top CMD yarns 220 and 222, but also passes over pick 220*a* only and below all other picks.

The weave pattern of fabric 200 maintains the adjacent bottom surface MD knuckles illustrated in fabric 100. As a result, the "phantom float" effect described for the fabric 100 is also present for the fabric 200, as is the relatively symmetric bottom CMD yarn for increased wear resistance. In addition, the potential for reduced caliper, reduced void volume, increased stability, and decreased permeability is also present.

Figure 9:
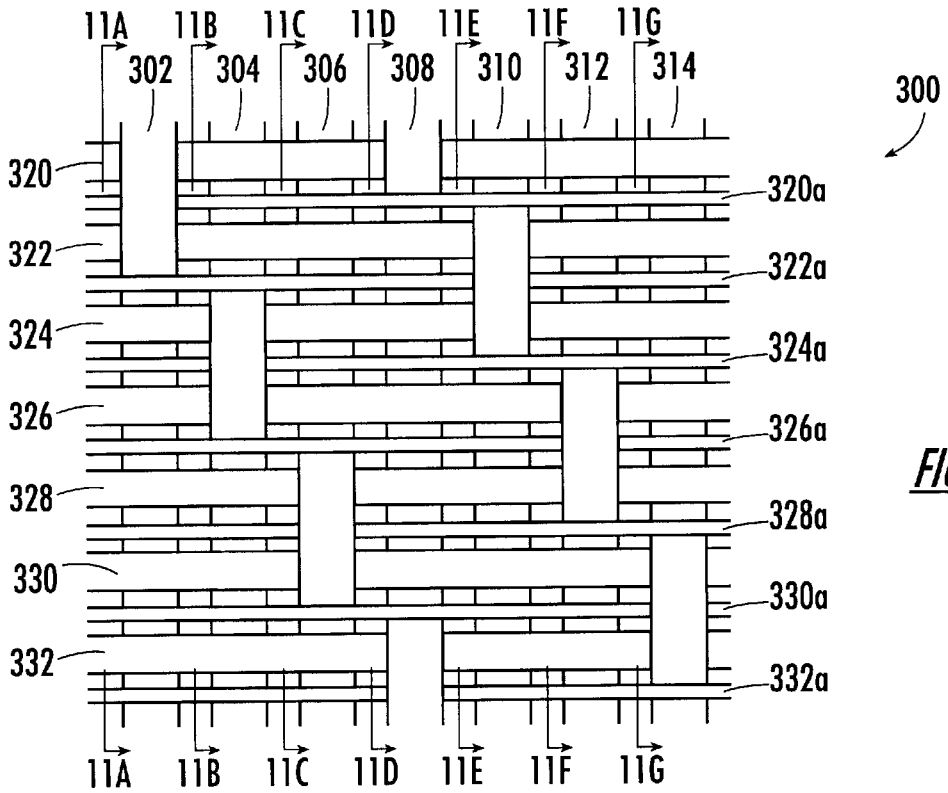
FIG. 9 is a top view of an alternative embodiment of a double layer papermaker's forming fabric of the present invention.
Figure 10:
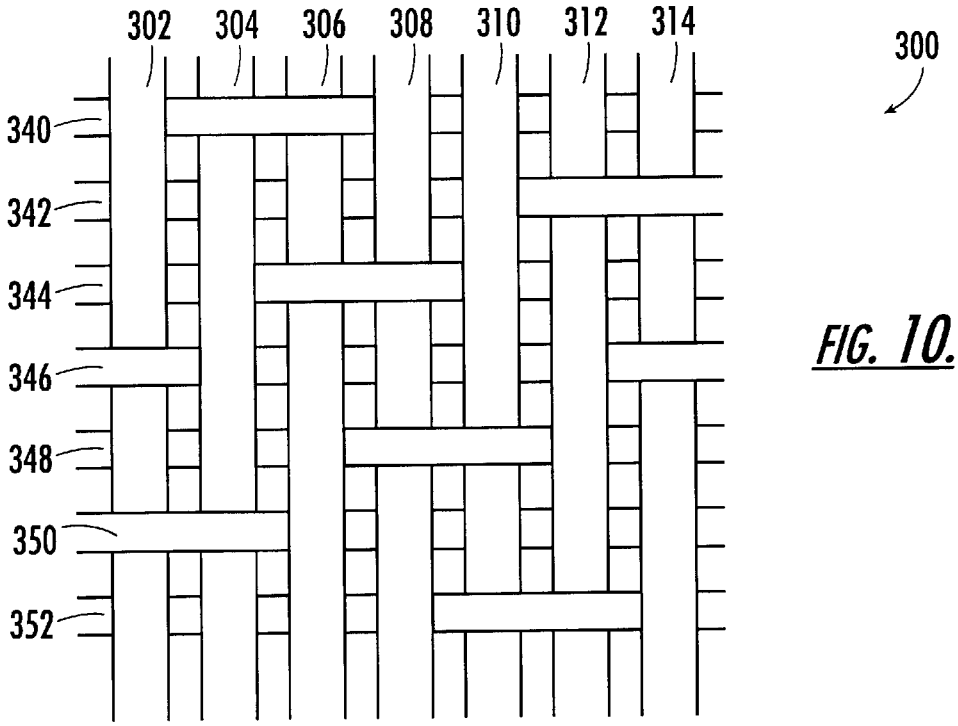
FIG. 10 is a partial top view of the fabric of FIG. 9 with the top CMD yarns and fiber support yarns removed.
Figures 11A, 11B, 11C, 11D, 11E, 11F, 11G:
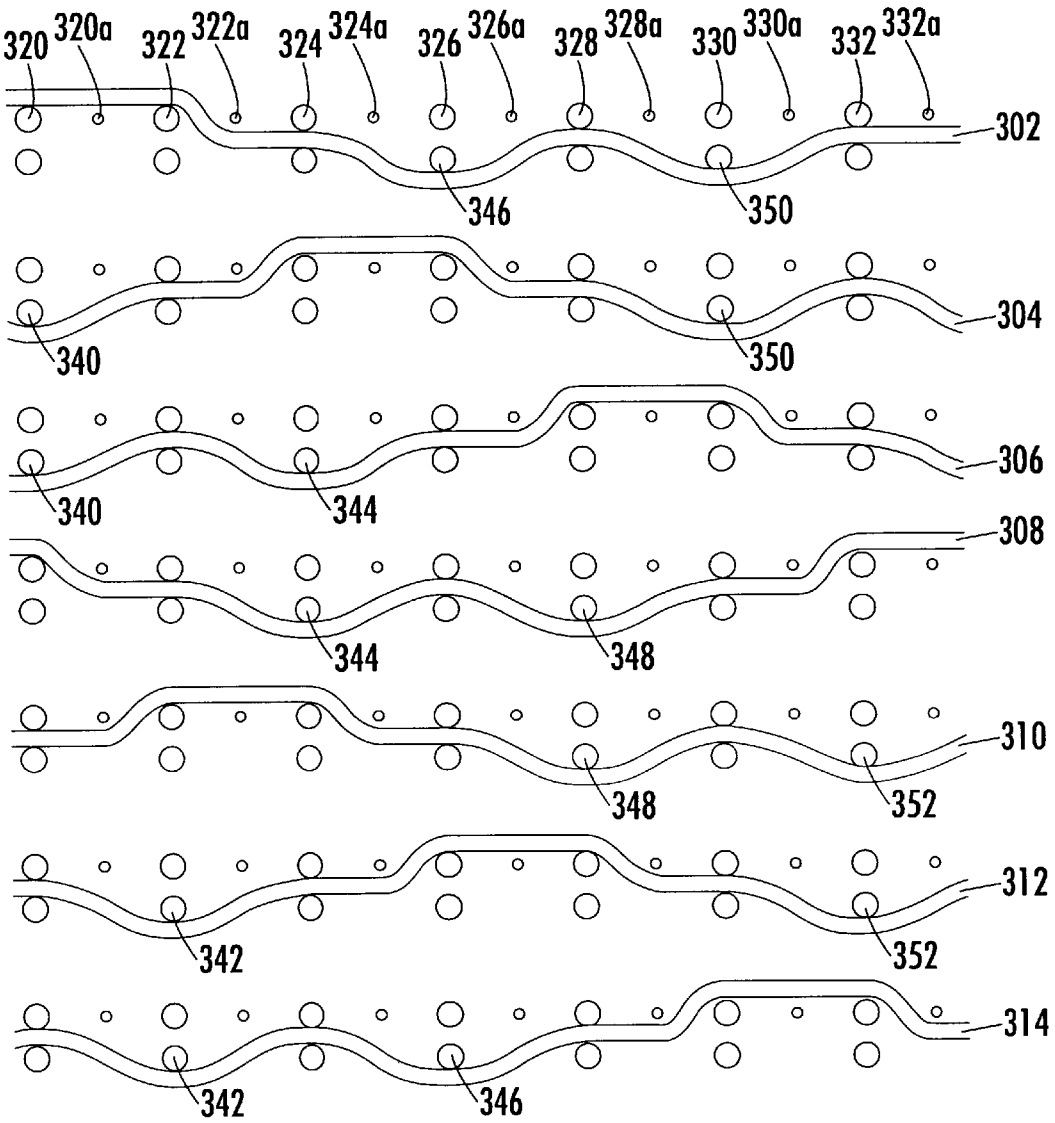
FIGS. 11A–11G are section views taken along, respectively, lines 11A—11A through 11G—11G of FIG. 9.
Figures 12A, 12B, 12C, 12D, 12E, 12F, 12G, 12H, 12I:
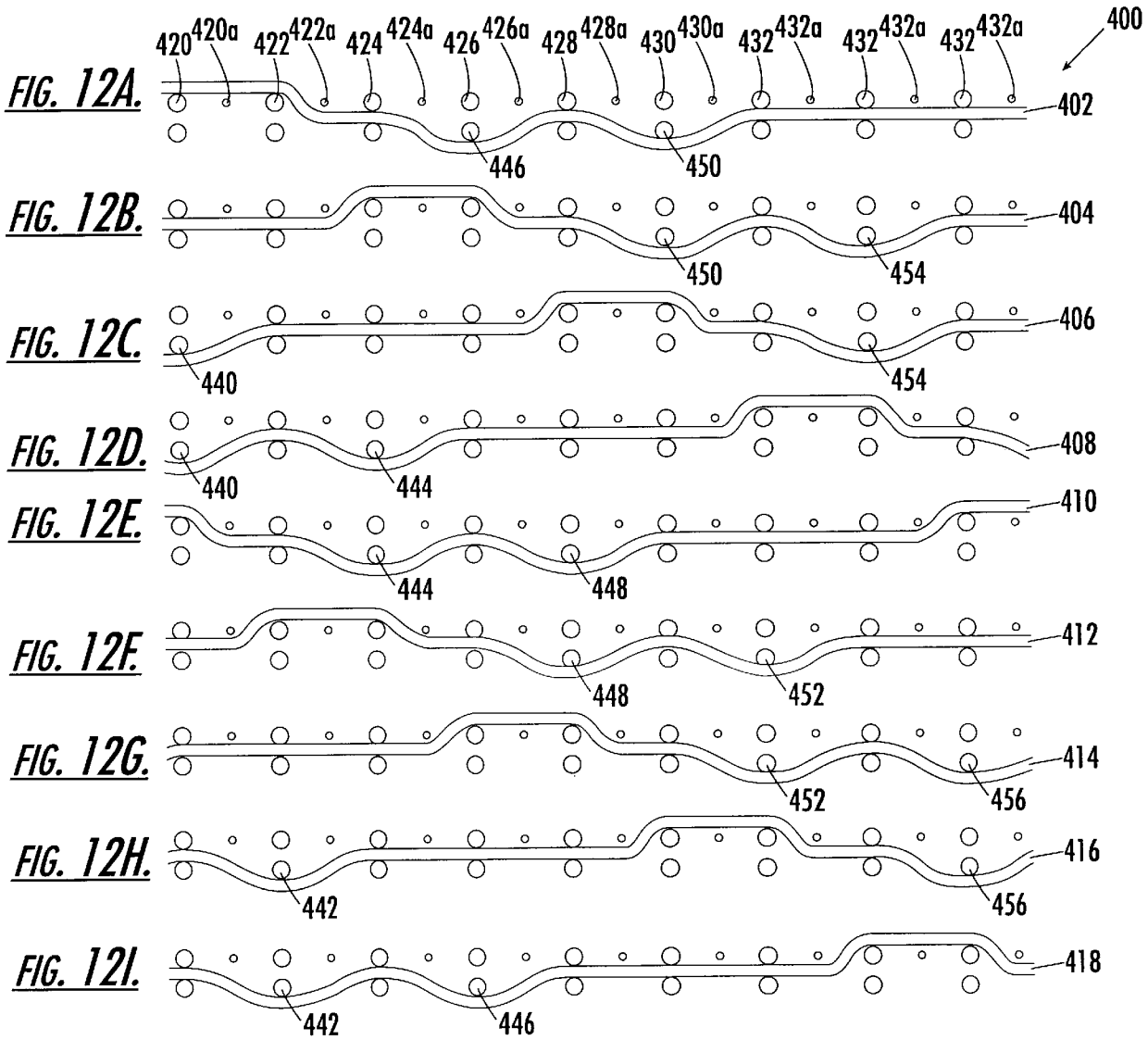
FIGS. 12A–12I are section views of consecutive machine direction yarns of a nine harness embodiment of a double layer papermaker's forming fabric of the present invention.
Figures 13A, 13B, 13C, 13D, 13E, 13F, 13G, 13H, 13I, 13J:
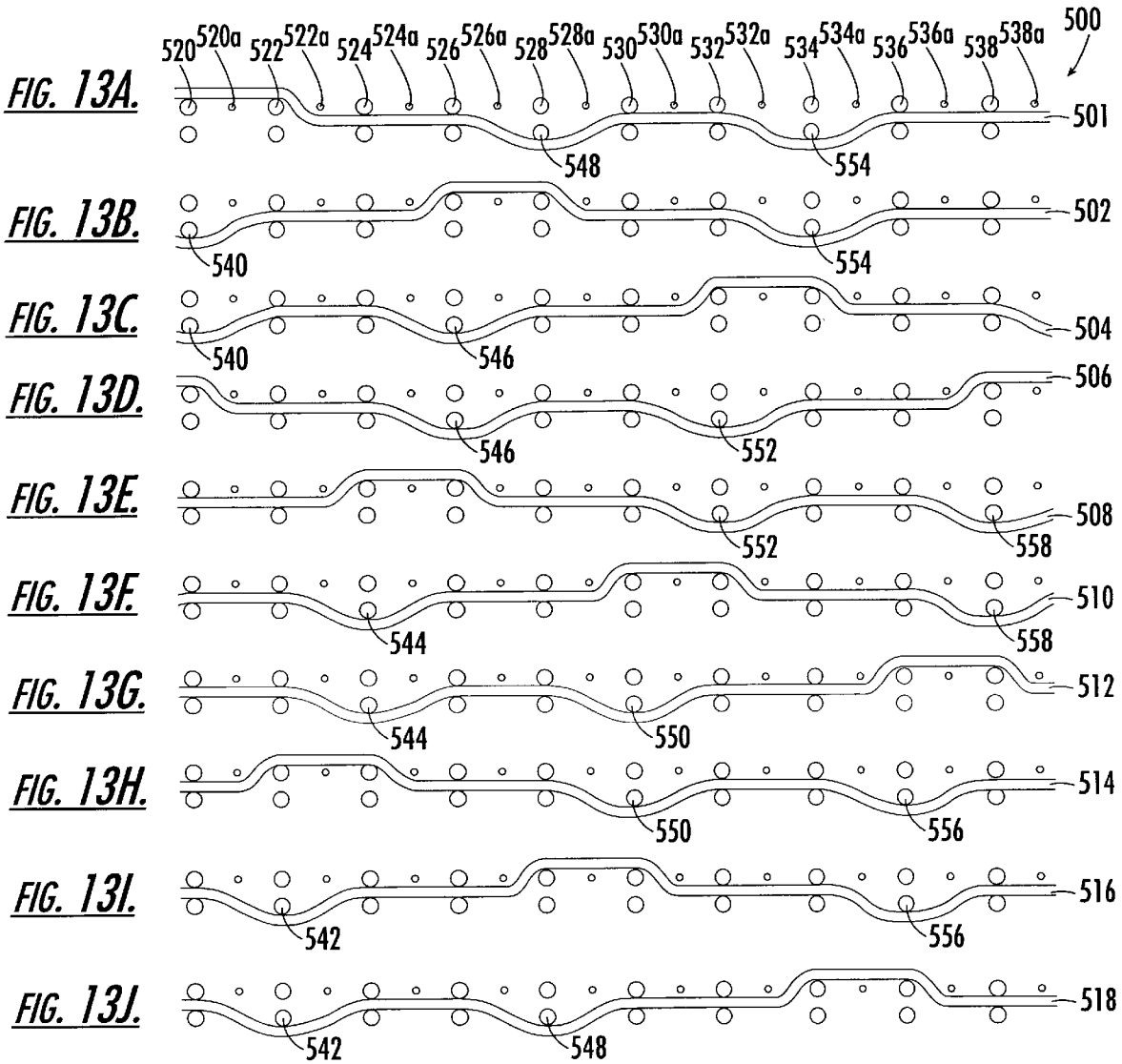
FIGS. 13A–13J are section views of consecutive machine direction yarns of a ten harness embodiment of a double layer papermaker's forming fabric of the present invention.

The principles of this weave pattern can be extended to fabrics having different numbers of MD and CMD yarns. Turning now to FIGS. 9–11, a repeat unit of a double layer fabric, designated broadly at 300, includes in its repeat unit seven MD yarns 302, 304, 306, 308, 310, 312, and 314 interwoven with seven top CMD yarns 320, 322, 324, 326, 328, 330, and 332, seven bottom CMD yarns 340, 342, 344, 346, 348, 350, and 352, and seven fiber support picks 320*a*, 322*a*, 324*a*, 326*a*, 328*a*, 330*a* and 332*a*. In the repeat unit, each MD yarn passes above two top CMD yarns and the pick sandwiched therebetween and passes below all other top CMD yarns and picks. Each MD yarn also passes below two bottom CMD yarns that are separated by one bottom CMD yarn. As an example, MD yarn 302 passes above top CMD yarns 320 and 322 as well as pick 320*a*, then passes below pick 322*a*, between top CMD yarn 324 and bottom CMD yarn 344, below bottom CMD yarn 346, between bottom CMD yarn 348 and top CMD yarn 328, below bottom CMD yarn 350, and between top CMD yarn 322 and bottom CMD yarn 352. Adjacent MD yarns are offset from one another in weaving sequence by two top CMD yarns; thus, MD yarn 302 passes above top CMD yarn 320 and 322, which adjacent MD yarn 304 passes above top CMD yarns 324 and 326. As a result of this two top CMD yarn offset, adjacent MD yarns form the distinctive side-by-side single float bottom layer knuckles seen in the fabrics 100 and 200 described above, and can provide the same performance advantages.

The same principles can also be applied to weave patterns having other numbers of MD yarns. FIGS. 12A–12I illustrate nine MD yarns 402, 404, 406, 408, 410, 412, 414, 416 and 418 of the repeat unit of a double layer fabric 400 as these MD yarns interweave with nine top CMD yarns 420, 422, 424, 426, 428, 430, 432, 434 and 436, nine bottom CMD yarns 440, 442, 444, 446, 448, 450, 452, 454 and 456, and nine fiber support picks 420*a*, 422*a*, 424*a*, 426*a*, 428*a*, 430*a*, 432*a*, 434*a* and 436*a*. In this pattern, each MD yarn passes over two top CMD yarns and the pick sandwiched therebetween, between the adjacent set of top and bottom CMD yarns, below the next bottom CMD yarn, between the next set of top and bottom CMD yarns, below the following bottom CMD yarn, and between the next three sets of top and bottom CMD yarns. For example, MD yarn 402 passes above top CMD yarns 420 and 422 as well as pick 420*a*, passes below pick 422*a* and between top and bottom CMD yarns 424, 444, passes below bottom CMD yarn 446, passes between top and bottom CMD yarns 428, 448, passes below bottom CMD yarn 450, and passes between top and bottom CMD yarn sets 432, 452, 434, 454, and 436, 456 (and under pick 436*a*). Adjacent MD yarns are offset in weaving sequence by two top CMD yarns, so while MD yarn 402 passes above top CMD yarns 420 and 422, adjacent MD yarn 404 passes above top CMD yarns 424 and 426 (see FIGS. 9A and 9B). As a result, the adjacent bottom layer MD knuckles found in the previously described fabrics are present here.

The same is true of a repeat unit of a ten harness fabric 500, the MD yarns of which are illustrated in FIGS. 13A–13J. As can be seen in FIGS. 13A–13J, the double layer fabric 500 includes ten MD yarns 501, 502, 504, 506, 508, 510, 512, 514, 516 and 518 that interweave with ten top CMD yarns 520, 522, 524, 526, 528, 530, 532, 534, 536 and 538, ten fiber support picks 520*a*, 522*a*, 524*a*, 526*a*, 528*a*, 530*a*, 532*a*, 534*a*, 536*a*and 538*a*, and ten bottom CMD yarns 540, 542, 544, 546, 548, 550, 552, 554, 556 and 558. In this fabric, each MD yarn passes over two top CMD yarns and the pick sandwiched therebetween, between the next two sets of top and bottom CMD yarns, below the next bottom CMN yarn, between the next two sets of bottom and top CMD yarns, below the following bottom CMD yarn, and between the next two sets of top and bottom CMD yarns. For example, MD yarn 501 passes above top CMD yarns 520 and 522 as well as pick 520*a*, below pick 522*a*, between sets of top and bottom CMD yarns 524, 544 and 526, 546, below bottom CMD yarn 548, between sets of top and bottom CMD yarns 530, 550 and 532, 552, below bottom CMD yarn 554, and between sets of top and bottom CMD yarns 536, 556 and 538, 558. Adjacent MD yarns are offset by three top CMD yarns; thus, as MD yarn 501 passes above top CMD yarns 520 and 522, adjacent MD yarn 502 passes above top CMD yarns 526 and 528. As a result, the adjacent bottom layer MD knuckles found in the previously described fabrics are present here; accordingly, this fabric can also exhibit the performance advantages described above.

Those skilled in this art will recognize that the principles of the present invention may also be applied to other double layer fabrics, whether they include fiber support picks or not. Also, the fabrics may include different numbers of yarns in the repeat unit (for example, eleven or twelve MD yarns), and the MD yarns may follow a different pattern as they pass over the top CMD yarns; as an example, the top layer have follow a pattern such as those illustrated in U.S. Pat. No. 5,937,914 and co-pending and co-assigned U.S. patent application Ser. No. 09/501,753, filed Feb. 10, 2000, the disclosures of each of which are hereby incorporated herein by reference in their entireties.

Figure 14:
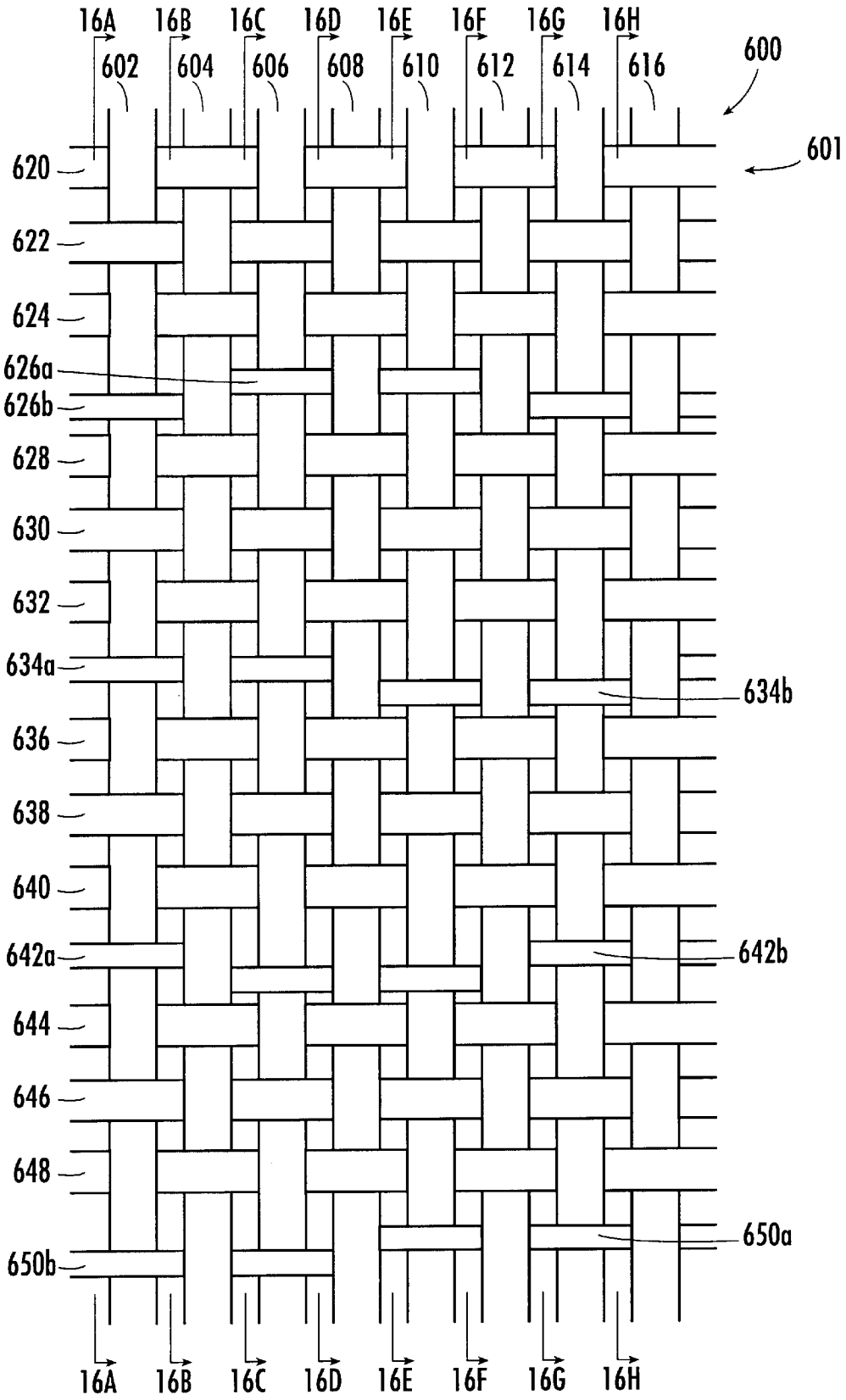
FIG. 14 is a top view of a triple layer papermaker's forming fabric of the present invention.
Figure 15:
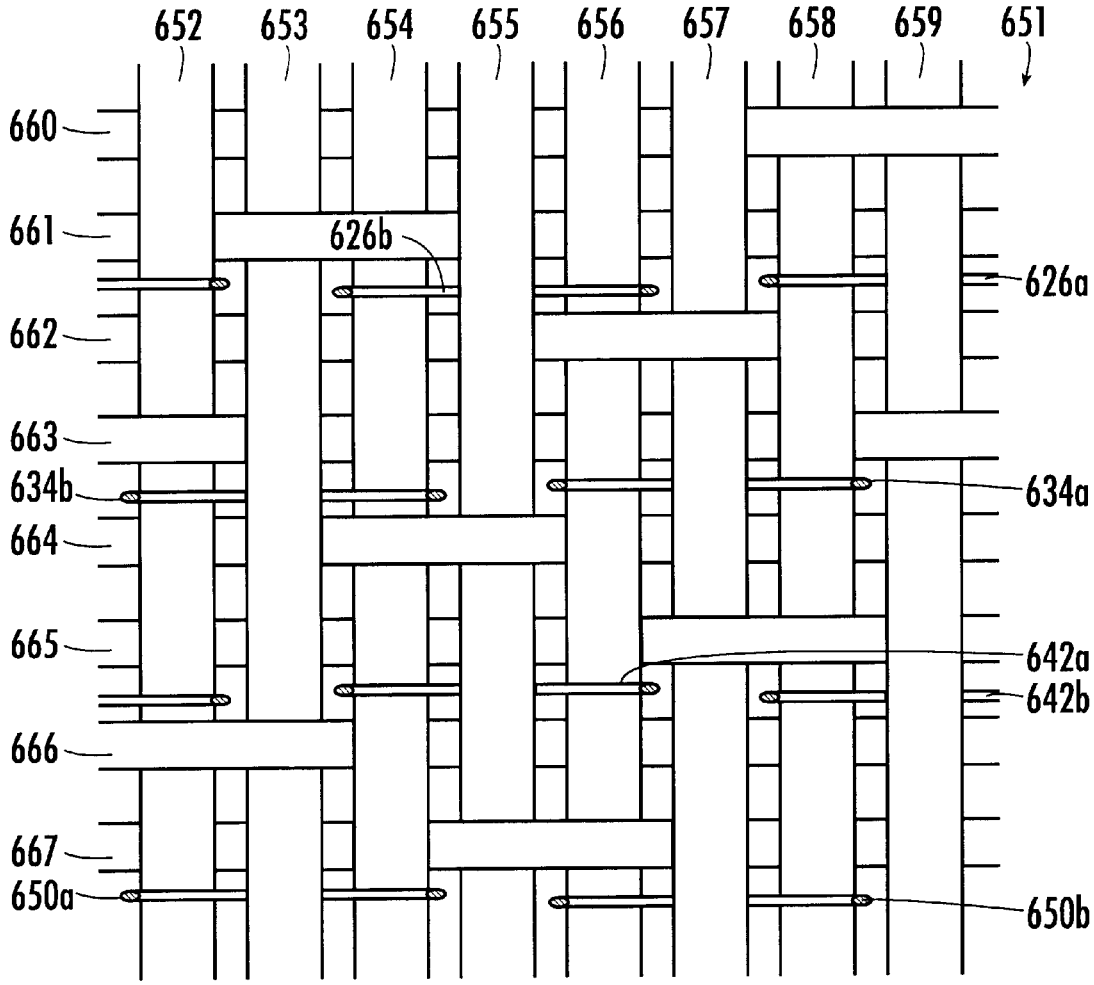
FIG. 15 is a top section view of the bottom layer of the fabric of FIG. 14.
Figures 16A, 16B, 16C, 16D, 16E, 16F, 16G, 16H:
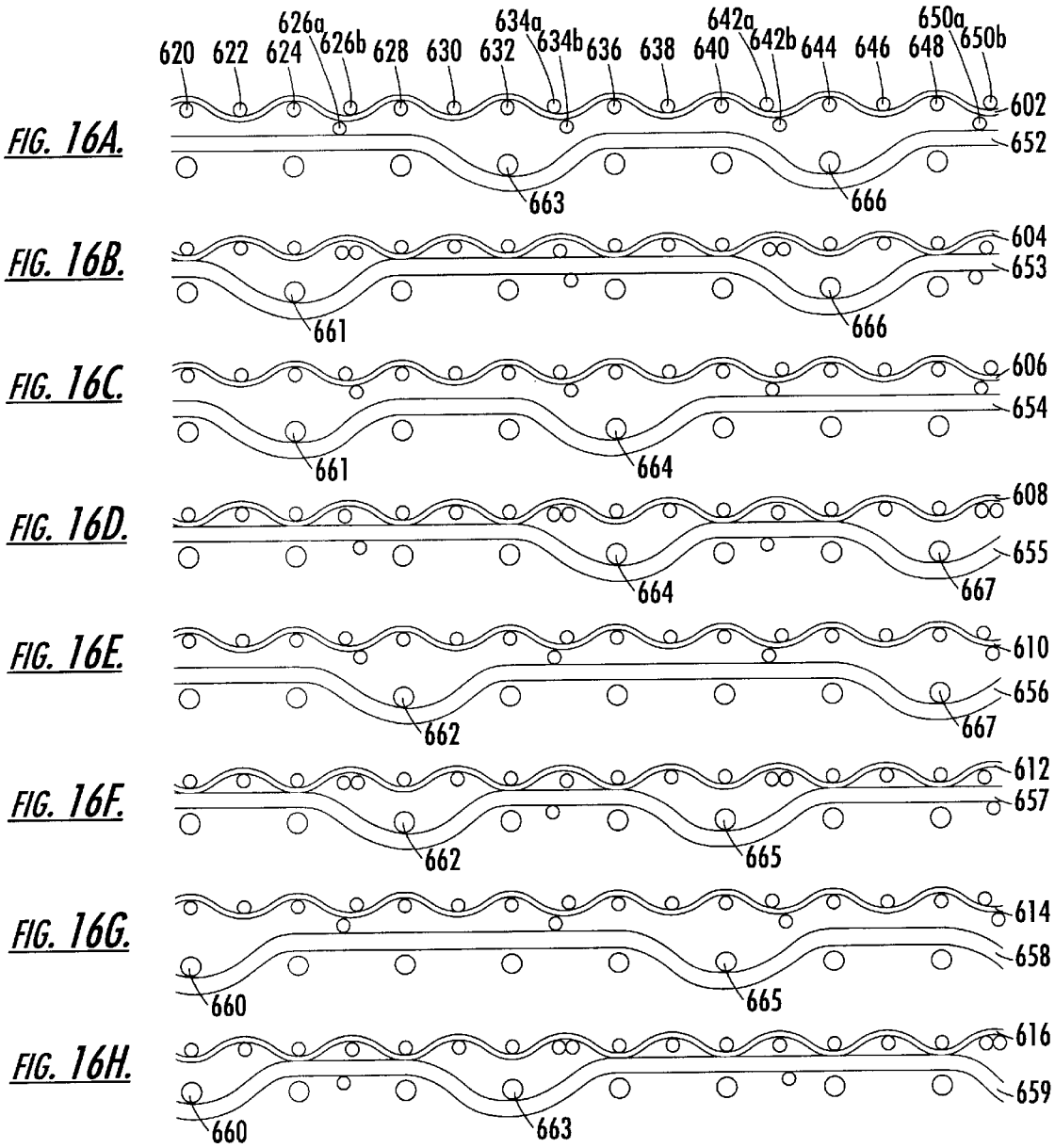
FIGS. 16A–16H are section views taken along, respectively, lines 16A—16A through 16H—16H of FIG. 14.

The concept of the present invention can also be applied to triple layer fabrics. As an example, a 16 harness triple layer fabric, a repeat unit of which is designated broadly at 600, is illustrated in FIGS. 14–16. The fabric 600 includes a top fabric layer 601 and a bottom fabric layer 651. The top fabric layer 601 includes eight top MD yarns 602, 604, 606, 608, 610, 612, 614, 616 interwoven with twelve top CMD yarns 620, 622, 624, 628, 630, 632, 636, 638, 640, 644, 646, 648 and four pairs of stitching yarn 626*a*, 626*b*, 634*a*, 634*b*, 642*a*, 642*b*, 650*a*, 650*b*. The top MD yarns and top CMD yarns are interwoven in a plain weave pattern, with the stitching yarns positioned between sets of three adjacent top CMD yarns and also interweaving with the top MD yarns in a plain weave pattern. The manner in which a plain weave surface is formed on the top layer via a combination of top MD yarns, top CMD yarns and stitching yarns is described in U.S. Pat. No. 4,501,113 to Osterberg and U.S. Pat. No. 5,967,195 to Ward, the disclosures of each of which are hereby incorporated by reference in their entireties.

The bottom fabric layer 651 comprises eight bottom MD yarns 652, 653, 654, 655, 656, 657, 658, 659 that are interwoven with eight bottom CMD yarns 660, 661, 662, 663, 664, 665, 666, 667. The weaving pattern of the bottom fabric layer 651 is such that each bottom MD yarn passes above four adjacent bottom CMD yarns, below a bottom CMD yarn, above two adjacent bottom CMD yarns, and below another bottom CMD yarn. Adjacent bottom MD yarns are offset from one another by three bottom CMD yarns. As a result, adjacent MD yarns pass below a common bottom CMD yarn to form adjacent bottom knuckles. For example, bottom MD yarn 652 passes below bottom CMD yarns 663 and 666, while adjacent bottom MD yarns 653 passes below bottom CMD yarns 661 and 666. As such, the performance advantages ascribed to this configuration for previously described fabrics may also present for the bottom fabric layer 651; in particular, for triple layer fabrics life potential and air permeability may be markedly improved over prior art triple layer fabrics.

It should also be noted that each stitching yarn of each stitching yarn pair passes below one bottom MD yarn as part of the repeat unit. For example, stitching yarns 626*a*, 626*b* pass below, respectively, bottom MD yarns 655, 659. The next stitching yarn pair passes below a bottom MD yarn that is offset by two bottom MD yarns, so, for example, stitching yarns 634*a*, 634*b* pass below, respectively, bottom MD yarns 653, 657. It should be noted that, in the illustrated and preferred configuration, there are twice as many top CMD yarns (assuming that each stitching yarn pair serves as one top CMD yarn for the purposes of this calculation) as bottom CMD yarns, and that each bottom CMD yarn is positioned below a corresponding top CMD yarn. As a result, there should generally be sufficient space between bottom CMD yarns for stitching yarns to interweave with the bottom MD yarns without interference.

Those skilled in this art will appreciate that triple layer fabrics of the present invention may be woven in different repeat patterns than those illustrated herein. For example, a triple layer fabric may be woven on 24 harnesses, wherein the bottom fabric layer includes 12 bottom MD yarns and twelve bottom CMD yarns, with each bottom CMD yarn following an "over 6/under 1/over 4/under 1" pattern relative to the bottom CMD yarns, and with adjacent MD yarns being offset from one another by five CMD yarns. As another example, a triple layer fabric of the present invention may be woven on 20 harnesses, wherein the bottom fabric layer includes ten bottom MD yarns and ten bottom CMD yarns, with each bottom CMD yarn following an "over 5/under 1/over 3/under 1" pattern relative to the bottom CMD yarns, and with adjacent MD yarns being offset from one another by four CMD yarns. Other triple layer fabrics can be contemplated that utilize 18, 28 or 30 harnesses.

Further, the top surface of the triple layer fabrics of the present invention may take other patterns on the top surface (such as other plain weave patterns, twills, broken twills, satins, and the like). Also, the stitching yarns may contribute to the weave pattern as illustrated in the embodiment of FIGS. 14 through 16, may contribute to a greater degree to the top surface (such as is illustrated in U.S. Pat. No. 5,967,195 to Ward), or may not contribute to the weave (as illustrated in U.S. Pat. No. 5,238,536 to Danby, U.S. Pat. Nos. 4,987,929 and 5,518,042 to Wilson, U.S. Pat. No. 4,989,647 to Marchand, U.S. Pat. No. 5,052,448 to Givin, U.S. Pat. No. 5,437,315 to Ward, U.S. Pat. No. 5,564,475 to Wright, U.S. Pat. No. 5,152,326 to Vohringer, and U.S. Pat. No. 4,501,303 to Osterberg).

The form of the yarns utilized in the fabrics of the present invention can vary, depending upon the desired properties of the final papermaker's' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermaker's' fabric. For example, the yarns may be formed of polypropylene, polyester, polyester alloys and copolymers, nylon, nylon alloys and copolymers, or the like. The skilled artisan should select a yarn material according to the particular application of the final fabric. In particular, round monofilament yarns formed of polyester or nylon are preferred.

Yarn sizes should be selected according to the desired performance of the fabric. For example, for a double layer fabric, MD yarns should have a diameter of between about 0.12 mm to 0.40 mm, top CMD yarns should have a diameter of between about 0.10 mm and 0.50 mm, and bottom CMD yarns should have a diameter of between about 0.16 mm and 0.70 mm. If fiber support picks are included, they should have a diameter of between about 0.10 mm and 0.30 mm, as should top CMD yarns used with fiber support picks. For a triple layer fabric, top MD yarns should have a diameter of between about 0.12 mm to 0.30 mm, top CMD yarns should have a diameter of between about 0.12 mm and 0.30 mm, bottom MD yarns should have a diameter of between about 0.20 mm and 0.30 mm, bottom CMD yarns should have a diameter of between about 0.20 mm and 0.70 mm, and stitching yarns should have a diameter of between about 0.10 mm and 0.30 mm.

Specific examples of double layer fabric configurations suitable for use with the present invention are set forth in Table 1 below.

TABLE 1

| Harnesses | Fiber Support Picks | MD Yarn Diameter (mm) | Top CMD Yarn Diameter (mm) | Bottom CMD Yarn Diameter (mm) | Pick Diameter (mm) |
|---|---|---|---|---|---|
| 7 | yes | 0.17 | 0.20 | 0.25 | 0.13 |
| 8 | no | 0.17 | 0.18 | 0.18 | none |
| 8 | yes | 0.17 | 0.20 | 0.25 | 0.13 |
| 9 | yes | 0.17 | 0.20 | 0.25 | 0.13 |
| 10 | yes | 0.17 | 0.20 | 0.25 | 0.13 |

Exemplary triple layer fabrics configurations suitable for use are set forth in table 2 below.

TABLE 2

| Harnesses | Top MD Yarn Diameter (mm) | Top CMD yarn Diameter (mm) | Bottom MD yarn Diameter (mm) | Bottom CMD Yarn Diameter (mm) | Stitching Yarn Diameter (mm) |
|---|---|---|---|---|---|
| 16 | 0.22 | 0.22 | 0.22 | 0.50 | 0.20 |
| 20 | 0.22 | 0.22 | 0.22 | 0.50 | 0.20 |
| 24 | 0.22 | 0.22 | 0.22 | 0.50 | 0.20 |

The foregoing embodiments are illustrative of the present invention, and are not to be construed as limiting thereof. The invention is defined by the following claims, with equivalents of the claims to be included therein.

That which is claimed is:

1. A papermaker's fabric, comprising:

a set of machine direction yarns;

a top set of cross machine direction yarns; and a bottom set of cross machine direction yarns interwoven with said set of machine direction yarns;

wherein said set of machine direction yarns, said top set of cross machine direction yarns, and said bottom set of cross machine direction yarns are interwoven in a repeat pattern in which each of said machine direction yarns passes below at least two nonadjacent bottom cross machine direction yarns, thereby forming bottom machine direction knuckles, wherein each adjacent pair of machine direction yarns passes below a common bottom cross machine direction yarn to form side-by-side bottom machine direction knuckles, and wherein machine direction yarns adjacent to and sandwiching said adjacent pair of machine direction yarns forming said side-by-side bottom knuckles pass over a top cross machine direction yarn positioned substantially directly above said bottom cross machine direction yarn under which said bottom knuckles are formed such that a phantom float is formed on said top cross machine direction yarn.

2. The papermaker's fabric defined in claim 1, wherein each of said machine direction yarns passes above at least two top cross machine direction yarns.

3. The papermaker's fabric defined in claim 1, further comprising a set of fiber support picks interwoven with said set of machine direction yarns.

4. The papermaker's fabric defined in claim 3, wherein said set of fiber support picks is interwoven with said set of machine direction yarns such that a fiber support pick is located between each pair of adjacent top cross machine direction yarns.

5. The papennaker's fabric defined in claim 3, wherein each of said machine direction yarns passes above two adjacent top cross machine direction yarns and at least one fiber support pick positioned between said two top cross machine direction yarns.

6. The papermaker's fabric defined in claim 1, wherein said set of machine direction yarns in said repeat unit comprises between 7 and 10 machine direction yarns.

7. The papermaker's fabric defined in claim 1, wherein said repeat unit comprises equal numbers of top and bottom cross machine direction yarns.

8. The papermaker's fabric defined in claim 1, wherein within said repeat unit, the interweaving sequence of each machine direction yarn is offset from the interweaving sequence of an adjacent machine direction yarn by two top cross machine direction yarns.

9. The papermaker's fabric defined in claim 1, wherein within the repeat unit, the interweaving sequence of each machine direction yarn is offset from the interweaving sequence of an adjacent machine direction yarn by three top cross machine direction yarns.

10. The papermaker's fabric defined in claim 1, wherein each of said machine direction yarns passes over one bottom cross machine direction yarn between said two nonadjacent bottom cross machine direction yarns.

11. The papermaker's fabric defined in claim 1, wherein each of said machine direction yarns passes over two bottom cross machine direction yarns between said two nonadjacent bottom cross machine direction yarns.

12. A triple layer papermaker's fabric, comprising:

a set of top machine direction yarns;

a set of top cross direction yarns interwoven with said top(machine direction yarns to form a top fabric layer;

a set of bottom machine direction yarns;

a set of bottom cross machine direction yarns interwoven with said bottom machine direction yarns to form a bottom fabric layer; and a plurality of cross machine direction stitching yarns interweaving with said top and bottom machine direction yarns to interconnect said top and bottom fabric layers;

wherein said bottom machine direction yarns and said bottom cross machine direction yarns are interwoven in a repeat pattern in which each of said bottom machine direction yarns passes below at least two nonadjacent bottom cross machine direction yarns, thereby forming bottom side machine direction knuckles, and wherein each adjacent pair of machine direction yarns passes below a common bottom cross machine direction yarn to form side-by-side bottom machine direction knuckles.

13. The papermaker's fabric defined in claim 12, wherein said stitching yarns are interwoven with said top machine direction yarns such that a pair of stitching yarns is blated between each pair of adjacent top cross machine direction yarns.

14. The papermaker's fabric defined in claim 13, wherein said stitching yarns, said top machine direction yarns, and said top cross machine direction yarns interweave to form a plain weave pattern on an upper surface of said top fabric layer.

15. The papermaker's fabric defined in claim 12, wherein said set of top machine direction yarns comprises between 8 and 12 top machine direction yarns.

16. The papermaker's fabric defined in claim 12, wherein each of wherein said bottom machine direction yarns passes over two adjacent bottom cross machine direction yarns between said two nonadjacent bottom cross machine direction yarns, such that each bottom machine direction yarn forms said bottom side machine direction knuckles separated by said two adjacent bottom cross machine direction yarns.

17. The papermaker's fabric defined in claim 16, wherein each stitching yarn passes between a respective set of said adjacent two bottom cross machine direction yarns as said stitching yarn passes below said bottom machine direction yarn forming said bottom side machine direction knuckles.

18. The papermaker's fabric defined in claim 12, wherein within the repeat unit, the interweaving sequence of each bottom machine direction yarn is offset from the interweaving sequence of an adjacent bottom machine direction yarn by three top cross machine direction yarns.

19. A double-layer papermaker's fabric, comprising:

a set of machine direction yarns;

a top set of cross machine direction yarns; and a bottom set of cross machine direction yarns interwoven with said set of machine direction yarns;

wherein said set of machine direction yarns, said top set of cross machine direction yarns, and said bottom set of cross machine direction yarns are interwoven in a repeat pattern in which each of said machine direction yarns passes below at least two nonadjacent bottom cross machine direction yarns, thereby forming bottom machine direction knuckles, wherein each adjacent pair of machine direction yarns passes below a common bottom cross machine direction yarn to form side-by-side bottom machine direction knuckles, wherein machine direction yarns adjacent to and sandwiching said adjacent pair of machine direction yarns forming said side-by-side bottom knuckles pass over a top cross machine direction yarn positioned substantially directly above said bottom cross machine direction yarn under which said bottom knuckles are formed such that a phantom float is formed on said top cross machine direction yarn, wherein each of said machine direction yarns passes above at least two adjacent top cross machine direction yarns, and wherein said repeat unit includes equal numbers of top and bottom cross machine direction yarns.

20. The papermaker's fabric defined in claim 19, further comprising a set of fiber support picks interwoven with said set of machine direction yarns.

21. The papermaker's fabric defined in claim 20, wherein said set of fiber support picks is interwoven with said set of machine direction yarns such that a fiber support pick is located between each pair of adjacent top cross machine direction yarns.

22. A triple layer papermaker's fabric, comprising a series of repeat units, each of which comprises:

a set of eight top machine direction yarns;

a set of top cross machine direction yarns interwoven with said top machine direction yarns in a plain weave pattern to form a top fabric layer;

a set of eight bottom machine direction yarns;

a set of bottom cross machine direction yarns interwoven with said bottom machine direction yarns to form a bottom fabric layer;

a plurality of cross machine direction stitching yarns interweaving with said top and bottom machine direction yarns to interconnect said top and bottom fabric layers;

wherein said top machine direction yarns and said bottom cross machine direction yarns are interwoven in a repeat pattern in which each of said bottom machine direction yarns passes below at least two nonadjacent bottom cross machine direction yarns, thereby forming bottom side machine direction knuckles, and wherein each adjacent pair of machine direction yarns passes below a common bottom cross machine direction yarn to form side-by-side bottom machine direction knuckles.

* * * * *

UNITED STATES PATENT AND TRADEMARK OFFICE

CERTIFICATE OF CORRECTION

PATENT NO. : 6,253,796 B1
DATED : July 3, 2001
INVENTOR(S) : Wilson et al.

It is certified that error appears in the above-identified patent and that said Letters Patent is hereby corrected as shown below:

Column 11,
Line 55, should read as follows: -- top machine direction yarns to form a top fabric layer; --

Column 12,
Line 9, should read read as follows: -- direction yarns such that a pair of stitching yarns is located --

Signed and Sealed this

Thirteenth Day of August, 2002

*Attest:*

*Attesting Officer*

JAMES E. ROGAN
*Director of the United States Patent and Trademark Office*